US009282835B2

(12) United States Patent
Jones

(10) Patent No.: US 9,282,835 B2
(45) Date of Patent: Mar. 15, 2016

(54) MULTI-FUNCTION SUPPORT APPARATUS

(71) Applicant: AURUM HOLDINGS, LLC, New York, NY (US)

(72) Inventor: Dawn Nichole Jones, New York, NY (US)

( * ) Notice: Subject to any disclaimer, the term of this patent is extended or adjusted under 35 U.S.C. 154(b) by 41 days.

(21) Appl. No.: 13/692,795

(22) Filed: Dec. 3, 2012

(65) Prior Publication Data

US 2014/0150184 A1 Jun. 5, 2014

(51) Int. Cl.
*A47G 9/10* (2006.01)
*A47C 7/42* (2006.01)

(52) U.S. Cl.
CPC ..... *A47G 9/1081* (2013.01); *A47C 7/42* (2013.01)

(58) Field of Classification Search
CPC ..... A47G 9/10
USPC ..... 5/645, 642, 636, 639, 640, 643
See application file for complete search history.

(56) References Cited

U.S. PATENT DOCUMENTS

| | | | | |
|---|---|---|---|---|
| 3,148,386 | A | 9/1964 | Shebib | |
| 3,234,623 | A * | 2/1966 | Rector | 27/21.1 |
| 5,146,641 | A * | 9/1992 | Zwickey | 5/628 |
| 5,457,832 | A | 10/1995 | Tatum | |
| 5,471,691 | A | 12/1995 | Ryndak | |
| 5,918,839 | A * | 7/1999 | DuBois | 248/118 |
| 6,935,697 | B2 * | 8/2005 | Conlon et al. | 297/423.41 |
| 2002/0088057 | A1 * | 7/2002 | Wassilefsky | 5/648 |
| 2003/0000019 | A1 | 1/2003 | Glaze | |

FOREIGN PATENT DOCUMENTS

DE 4306001 A1 * 9/1993

* cited by examiner

*Primary Examiner* — Fredrick Conley
(74) *Attorney, Agent, or Firm* — Law Offices of Alozie N. Etufugh, PLLC

(57) ABSTRACT

A multi-function support apparatus having sections that are adapted to support the neck and head of a user while also preserving the user's hair style. The apparatus includes peak sections which are adapted to provide inclinational support for a user's head and sections that provide lumbar support for a user. The apparatus also includes curvature sections within which a user may drape and protect their hair.

11 Claims, 3 Drawing Sheets

MULTI-FUNCTION SUPPORT APPARATUS

FIELD OF THE INVENTION

The present invention is generally related to multi-function support apparatuses for providing comfort to different parts of the body while preserving the hair style of individuals.

BACKGROUND OF THE INVENTION

A major problem with individuals who have had their hair styled in a particular manner is their inability to conserve the hairstyle when they lie down. Having had their hair done professionally, most individuals normally sleep or lie down in different awkward positions to avoid ruining their recently styled hair. As such, there is a need for a multi-function support apparatus that will enable individuals to preserve their recently styled hair while also enabling them to have a comfortable night's sleep. There is also a need a need for a multi-function support apparatus that would enable an individual to maintain a comfortable posture while sitting at a desk or lying down.

SUMMARY OF THE INVENTION

In light of the foregoing problems, it is an object of the present invention to provide a multi-function support apparatus that would enable the conservation of a user's hairstyle while at the same time enable the user to enjoy a restful sleep. The multi-function support apparatus envisioned by the present invention may be used with or without hair style preserving products such as hair rollers, scarves, or wraps. The multi-function support apparatus as envisioned by the present invention would also enable the prolonging of an individual's hair style after the individual has had their hair styled by professional stylists as the hair style will no longer be ruined when the user lies down. The multi-function support apparatus may also be used to support a user's head & neck in an effort to preserve a user's hair style while the user is lying down or sleeping. As such, advantages of the multi-function support apparatus as contemplated by the present invention include: reduction of the time spent maintaining one's hair style, preservation of professionally done hair styles or a hair style that is of much significance to the individual; and providing one with a comfortable night's rest without the individual having to sleep in awkward positions in an effort to preserve his/her styled hair.

The multi-function support apparatus as envisioned by the present invention may also be used to support the lumbar region of a user's back. It may also be used to support a user's leg at the knee, calf or thigh when the user's leg needs to be elevated. The multi-function support apparatus can also be used to support the head & neck of a user when the user is lying down. Further, the multi-function support apparatus may be used to support a user's lumbar region of the user's back while the user is sitting at a desk or chair.

The multi-function support apparatus as envisioned by the present invention, offers more concentrated support than the traditional rectangular multi-function support apparatus. This is accomplished by way of its compact shape and strategically located curvatures in the multi-function support apparatus. By placing the curvature(s) in the area where support is needed (e.g. a user's head, neck, lumbar or various regions of the leg) the multi-function support apparatus offers concentrated support by elevating that part of the body significantly from the surface.

In one aspect of an embodiment of the present invention, the multi-function support apparatus may include a middle section, which may be adapted to support the neck and head of a user. The multi-function support apparatus may also include two peak sections, where each peak section may have a base which is contiguous with the middle section and where each base of the two peak sections is located at a distance offset from the immediately adjacent end of the middle section. The two peak sections may be adapted to provide inclinational support for a user's head. The multi-function support apparatus may additionally include a bottom section which is located below and contiguous with the middle section. The bottom section may extend from one end of the middle section to the other end of the middle section and may be adapted to provide a base and stable support for the middle section and the two peak sections. The bottom section may be able to provide such support by way of certain packing material used in the bottom section.

In one aspect of an embodiment of the present invention, the middle section may be dimensioned to allow a user to place the user's hair over a rear section of the middle section in order to preserve the user's hairstyle.

In one aspect of an embodiment of the present invention, each peak section may include an inner concave side which extends downwardly from the top of each peak. Each peak section may also include an outer concave side which extends downwardly from the top of each peak toward an immediately adjacent end of the middle section. In another aspect, the concave sides of the peak sections may be circular.

In another aspect of an embodiment of the present invention, the region of the middle section between the peak sections may be flat.

In another aspect of an embodiment of the present invention, a line drawn from one end of the middle section to the top of one of an immediately adjacent peak section may make an angle of 75 degrees with the horizontal.

In another aspect of an embodiment of the present invention, a line drawn from one end of the flat region of the middle section to the top of an immediately adjacent peak section may make an angle of 78 degrees with the horizontal.

In a further aspect of an embodiment of the present invention, the multi-function support apparatus may include a middle section, where the middle section may have two concave sections and a flat section. The flat section may be located between the concave sections and the concave sections may be concave in an opposite manner relative to one another. The multi-function support apparatus may include two shoulder sections, each shoulder section being contiguous with a respective concave section of the middle section, each of the shoulder sections having a flat top which extends away from the middle section. The multi-function support apparatus may additionally include a bottom section which is located below and contiguous with the middle section. Each end of the bottom section may be contiguous with each respective shoulder section by way of a curvature formed between each respective end of the bottom section and an end of each respective shoulder section.

In a further aspect of an embodiment of the present invention a line drawn between the end points of the curvature makes an angle of 79 degrees with the horizontal.

In a further aspect of an embodiment of the present invention a line drawn from the beginning edge of a shoulder section and the start point of the middle section's flat portion may make an angle of 78 degrees with the horizontal.

In a further aspect of an embodiment of the present invention the middle section may be dimensioned to allow a user to place the user's hair over a rear section of the middle section in order to preserve the user's hairstyle.

BRIEF DESCRIPTION OF THE DRAWINGS

The features and advantages of aspects of the present invention will become more apparent from the detailed description set forth below when taken in conjunction with the claims and drawings, in which like reference numbers indicate identical or functionally similar elements.

DETAILED DESCRIPTION OF THE INVENTION

In one aspect of an embodiment of the present invention, certain lengths, widths and strategically placed curvatures of the multi-function support apparatus as envisioned in the invention provide the stable support needed to elevate the user's head and neck and/or lumbar area from the surface it lies against.

The multi-functional support apparatus may have a flat base with strategically placed curvatures that allow a user to find a comfortable head position while preserving the head from compressing or lying on the recently styled hair. The curvature of the multi-function support apparatus in the middle section along with the firmness of the packing material used in the multi-function support apparatus provide stable support for the user's lumbar region when the user is sitting down or lying on their back.

The multi-functional support apparatus may have an elongated inner region and strategically placed curvatures that make it unique in form and function. In one aspect of an embodiment of the present invention, the multi-function support apparatus may have both inner and outer curvatures. In one aspect, the elongated inner region may provide support elevation for the user's head and neck thereby preventing the head & neck from compressing the recently styled hair. An outer curvature incorporated in one aspect of the present invention, when placed under or at the user's ear when the user is lying down (either one their right or left side) provides an area for the user's hair to lay (or flow) freely without being compressed by the user's head. In another aspect of an embodiment of the present invention, the inner region and curvatures provide support for the user's lumbar region while the outer curvatures allow for adjustment of the entire inner region to the width of the user's back.

Figure 1:
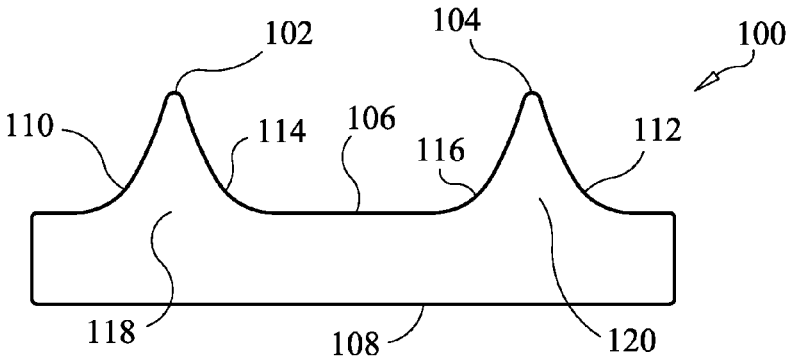
FIG. 1 illustrates a rear view of a multi-purpose support apparatus according to an aspect of an embodiment of the present invention.
Figure 2:
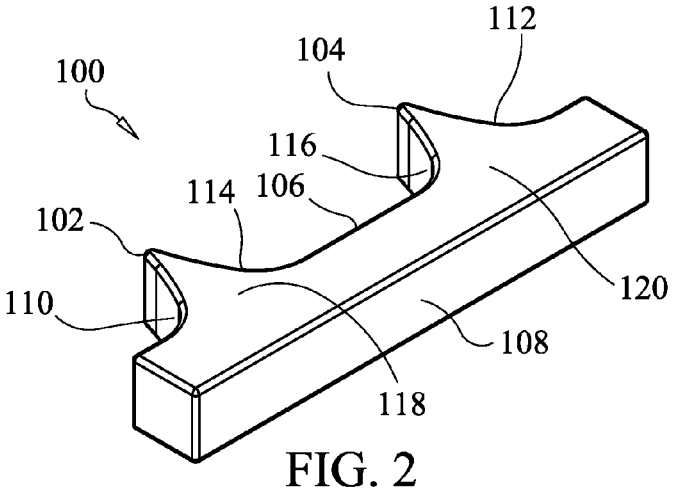
FIG. 2 illustrates a side perspective view of a multi-purpose support apparatus according to an aspect of an embodiment of the present invention.
Figure 3:
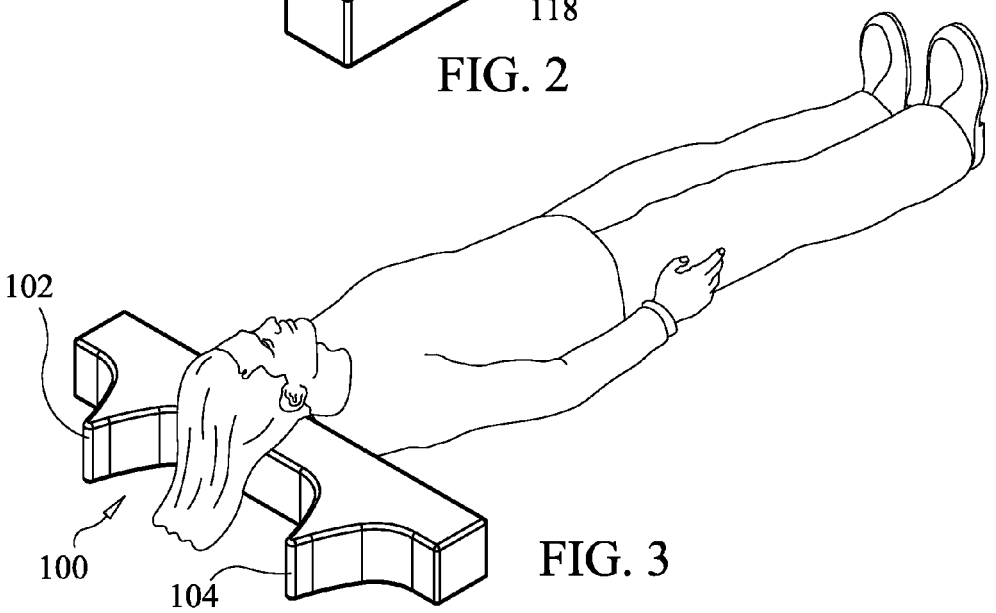
FIG. 3 illustrates a perspective view of a multi-purpose support apparatus with a user according to an aspect of an embodiment of the present invention.

Referring now to FIGS. 1 through 3, rear and perspective views of a multi-purpose support apparatus 100 according to aspects of embodiments of the present invention are shown. Multi-purpose support apparatus 100 is shown with peaks 102 and 104. Peaks 102 and 104 are shown having outer concave sides 110 and 112 along with inner concave sides 114 and 116 respectively. The concavities allow for a user's hair to be draped over the multi-function support apparatus 100 as shown in FIG. 3 thereby preserving the user's hair style.

In one aspect of an embodiment of the present invention, a line drawn from one end of the middle section 106 to the top of one of an immediately adjacent peak section may make an angle of 75 degrees with the horizontal. In another aspect of an embodiment of the present invention, a line drawn from one end of the flat region of the middle section 106 to the top of an immediately adjacent peak section may make an angle of 78 degrees with the horizontal. While not limiting to the design and make of multi-function support apparatus 100, these angles, may be used, in one aspect, to help determine the concave curvatures of peaks 102 and 104.

Multi-purpose support apparatus 100 may have a middle section 106 which, in one aspect of an embodiment of the present invention, may have a flat region between peaks 102 and 104. This would enable a user to lie down and obtain lumbar support at this location of middle section 106. Peaks 102 and 104 along with middle section 106 make multi-purpose support apparatus 100 unique in its form and function. The middle section 106 between peaks 102 and 104 provides support elevation for a user's head and neck thereby preventing the user's head and/or neck from compressing the user's hair. The outer curvature, when placed under or at the user's ear when the user is lying on the right or left side also provides an area for the user's hair to lay (or drape) freely without being compressed by the user's head.

In one aspect, multi-purpose support apparatus 100 may also include a bottom section 108 which may be located below middle section 106. In one aspect, bottom section 108 provides support for middle section 106 and peaks 102 and 104. Peaks 102 and 104 have respective bases 118 and 120 which are contiguous with middle section 106. Bases 118 and 120 are positioned at a location offset from each respective end of middle section 106. The inner curvatures of peaks 102 and 104 along with the firmness of the material used in bottom section 108 provide stable support for a user's lumbar region while he/she is sitting or laying down on their back while using multi-purpose support apparatus 100. In one aspect of an embodiment of the present invention, bottom section 108 may be made of foam material to provide comfort to the user. Bottom section 108 may also comprise of material required to strengthen and provide support for middle section 106 and peaks 102 and 104.

In one aspect of an embodiment of the present invention, the flat region of middle section 106 provides support elevation for a user's head and neck. The same region would also enable the user to drape his/her hair over the flat portion of middle section 106 as shown in FIG. 3. As such, the user's hair would not be compressed by his/her head and/or neck when the user lies down. When used in this way, the curvatures provide room for the user's hair when the user is lying on either their right or left side with the user's neck and chest placed on middle section 106. In another aspect according to an embodiment of the present invention, the user may lay his/her head down at either bases 118 or 120 (adjacent to concave sides 110 or 112, respectively) thereby allowing the user's hair to drape down within concave sides 110 or 112, respectively.

Figure 4:
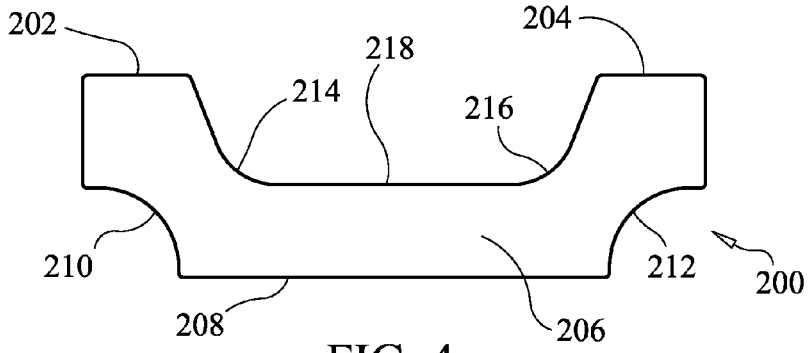
FIG. 4 illustrates a rear view of a multi-purpose support apparatus according to another aspect of an embodiment of the present invention.
Figure 5:
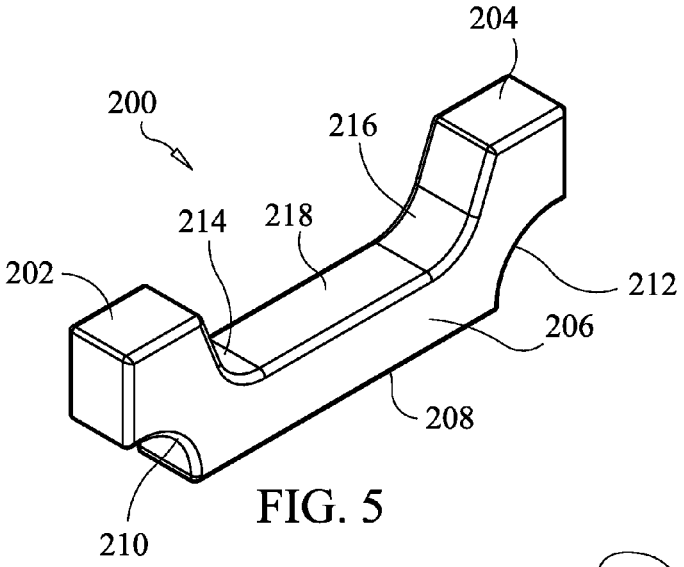
FIG. 5 illustrates a side perspective view of a multi-purpose support apparatus according to another aspect of an embodiment of the present invention.

Referring now to FIGS. 4 and 5, perspective views of a multi-function support apparatus 200 according to additional aspects of embodiments of the present invention are shown. Multi-function support apparatus 200 is shown with middle section 206, having two concave sections 214 and 216 and a flat section 218. Flat section 218 is located between concave sections 214 and 216. Concave sections 214 and 216 are each positioned in an opposite concave manner relative to one another as shown. Multi-function support apparatus 200 also includes shoulder sections 202 and 204, each shoulder section being contiguous with a respective concave section of middle section 206—in other words, shoulder section 202 is contiguous with concave section 214 while shoulder section 204 is contiguous with concave section 216. Shoulder sections 202 and 204 each have a flat top which extends away from middle section 206.

Multi-function support apparatus 200 further includes bottom section 208 below and contiguous with middle section 206. Each end of bottom section 208 is connected with an adjacent shoulder section of multi-function support apparatus by way of curvatures 210 and 212. In an aspect of an embodiment of the present invention a line drawn between the points of either curvature 210 or 212 makes an angle of 79 degrees with the horizontal. While not limiting to the design and make of multi-function support apparatus 200, these angles, may be used, in one aspect, to help determine the curve of curvatures 210 and/or 212.

The locations of curvatures 210 and 212 allow for the free movement of a user's chin which allows for a variety of the user's head tilts as the user finds or adjusts for a more comfortable position. This may be made possible when multi-purpose support apparatus 200 is placed lying flat on bottom section 208 and flat section 218 is placed against the user's chest and under the user's neck.

In another aspect of an embodiment of the present invention a line drawn from the top edge of the concave side of shoulder section 202 and the adjacent start point of flat section 218 may make an angle of 78 degrees with the horizontal. The same may be true for shoulder section 204 and the adjacent start point of flat section 218. While not limiting to the design and make of multi-function support apparatus 200, these angles, may be used, in one aspect, to help determine the concave sides of shoulder sections 202 and 204.

Figure 6:
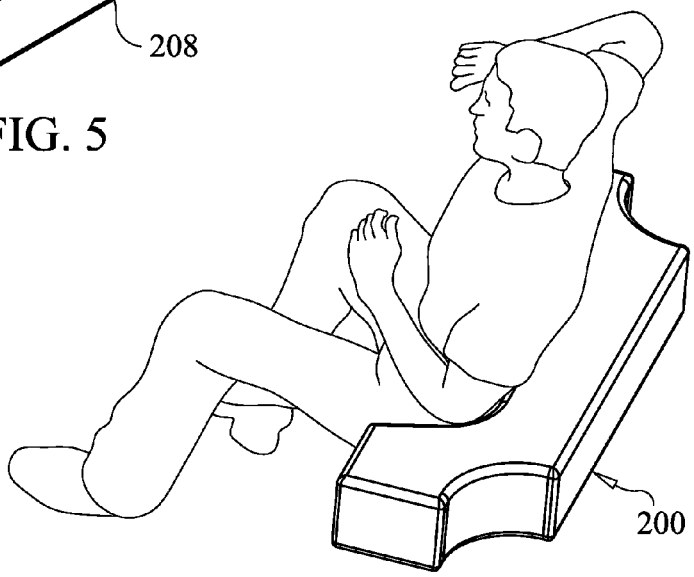
FIG. 6 illustrates a perspective view of a multi-purpose support apparatus with a user according to another aspect of an embodiment of the present invention.

Referring now to FIG. 6, a perspective view of a multi-purpose support apparatus 200 with a user according to another aspect of an embodiment of the present invention is shown. Here, the multi-function ability of the apparatus is shown with the user supporting his lumbar position with apparatus 200. The user is able to do so by reclining within flat section 218. In one aspect, bottom section 208 may be placed against the back of a seat, a wall or solid surface to provide additional support for apparatus 200 as the user reclines and seeks lumbar support.

Figure 7:
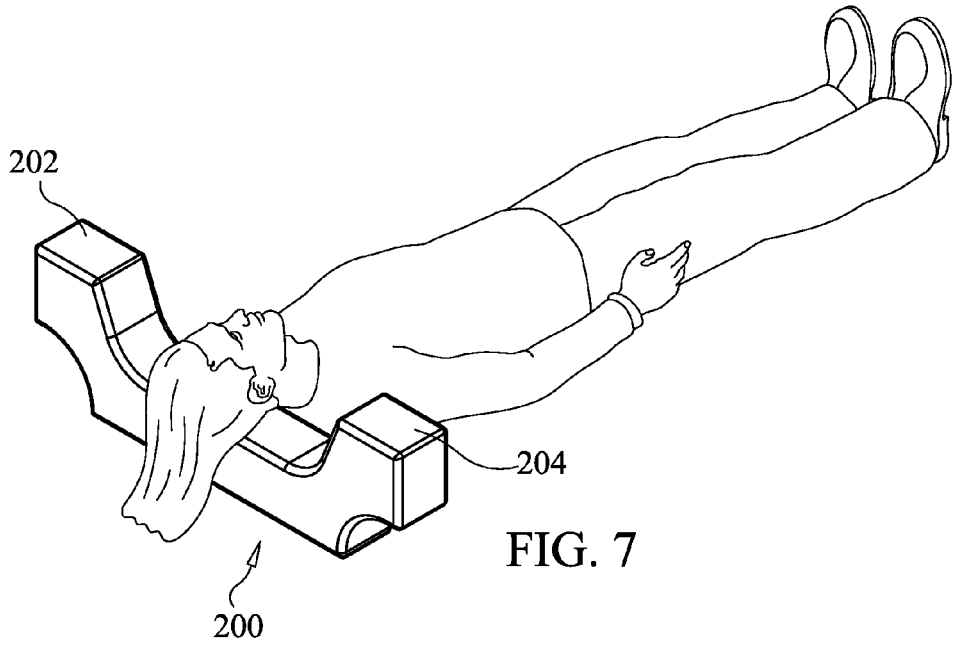
FIG. 7 illustrates a perspective view of a multi-purpose support apparatus as being used according to an aspect of an embodiment of the present invention.
Figure 8:
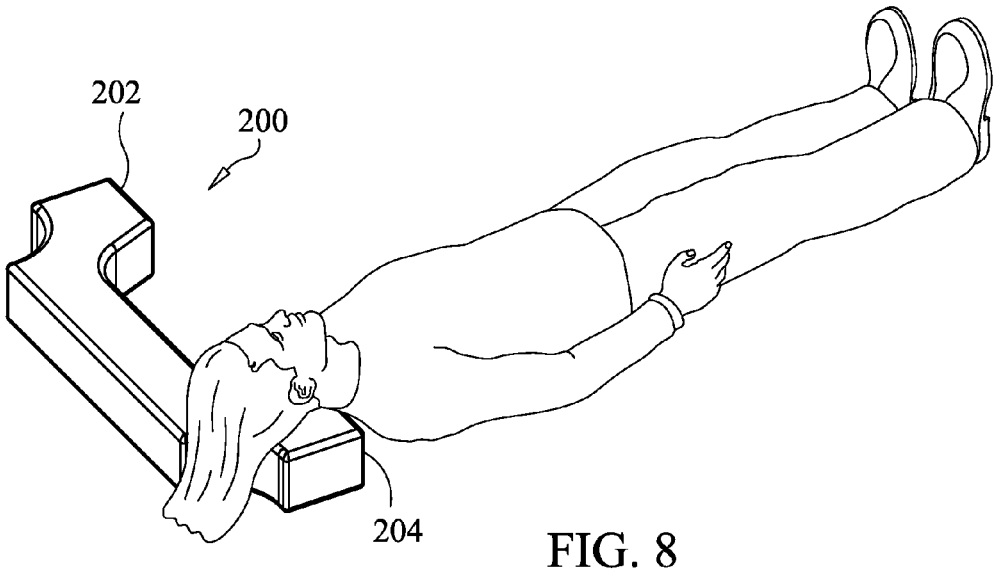
FIG. 8 illustrates a perspective view of a multi-purpose support apparatus as being used according to another aspect of an embodiment of the present invention.

Referring now to FIGS. 7 & 8, perspective views of a multi-purpose support apparatus 200 as being used according to additional aspects of embodiments of the present invention are shown. Here, the user is shown laying down within flat section 218 and draping his/her hair over the side of apparatus 200 as shown. In an alternate aspect, the user may lay down on shoulder section 204 while draping his/her hair into curvature 212. The user's hair style is thus preserved and not ruined as the user's hair will be clear from the user's head and/or neck.

Although this present invention has been disclosed with reference to specific forms and embodiments, it will be evident that a great number of variations may be made without departing from the spirit and scope of the present invention. For example, steps may be reversed, equivalent elements may be substituted for those specifically disclosed and certain features of the present invention may be used independently of other features—all without departing from the present invention as defined in the appended claims.

What is claimed is:

1. A multi-function support apparatus of unitary structure comprising:

a rectangular section said rectangular section comprising a first solid peak section extending from one surface of said rectangular section and having a base, outer and inner concave sides, said first peak section being located at a distance offset from a first end of said rectangular section, said outer concave side of said first peak section being contiguous with a first flat portion of said rectangular section, said first flat portion extending a distance from said first end of said rectangular section up to said outer concave side of said first peak section;

a second solid peak section extending from one surface of said rectangular section and having a base, outer and inner concave sides, said second peak section being located at a distance offset from a second end of said rectangular section, said outer concave side of said second peak section being contiguous with a second flat portion of said rectangular section, said second flat portion extending a distance from said second end of said rectangular section up to said outer concave side of said second peak section, wherein said first and second ends are opposite ends of said rectangular section;

a flat middle section, adapted to support the neck and head of a user, wherein said middle section is contiguous with, and extends between said inner concave sides of said first and second peak sections; and a bottom section, located below said middle section and said bases of said peak sections, said bottom section extending from said first end of said rectangular section to said second end of said rectangular section, said bottom section being adapted to provide a base and stable support for said flat portions, said middle section and said two peak sections.

2. The multi-function support apparatus according to claim 1 wherein said middle section is dimensioned to allow a user to place said user's hair over a rear section of said middle section in order to preserve said user's hairstyle.

3. The multi-function support apparatus according to claim 1, wherein each peak section comprises of an inner concave side downwardly extending from the top of each peak and wherein each peak section comprises of an outer concave side downwardly extending from the top of each peak toward an immediately adjacent end of said middle section.

4. The multi-function support apparatus according to claim 3, wherein said concave sides of said peak sections are parabolic.

5. The multi-function support apparatus of claim 1 wherein the region of said middle section between said peak sections is flat.

6. The multi-function support apparatus according to claim 5, wherein a line drawn from one end of said flat region of said middle section to the top of an immediately adjacent peak makes an angle of 78 degrees with the horizontal.

7. The multi-function support apparatus according to claim 1, wherein a line drawn from one end of said middle section to the top of one of an immediately adjacent peak makes an angle of 75 degrees with the horizontal.

8. A multi-function support apparatus comprising:

a middle section, said middle section having two concave sections and a non-curved flat section, said flat section being between said concave sections, said concave sections being concave in an opposite manner relative between them;

two shoulder sections, each shoulder section being contiguous with a respective concave section of said middle section, each of said shoulder sections having a non-curved flat top parallel to the non-curved flat section of the middle section, wherein each shoulder extends away from the point of contiguity with each respective concave section; and a bottom section below and contiguous with said middle section, wherein each end of said bottom section is contiguous with each respective shoulder section via a curvature formed between each respective end of said bottom section and an end of each respective shoulder section.

9. The multi-function support apparatus according to claim 8, wherein a line drawn between the end points of said curvature makes an angle of 79 degrees with the horizontal.

10. The multi-function support apparatus according to claim 8, wherein a line drawn from the beginning edge of a shoulder section and the start point of the middle section's flat portion makes an angle of 78 degrees with the horizontal.

11. The multi-function support apparatus according to claim 8, wherein said middle section is dimensioned to allow a user to place said user's hair over a rear section of said middle section in order to preserve said user's hairstyle.

* * * * *